US007115079B2

(12) United States Patent
Yu

(10) Patent No.: US 7,115,079 B2
(45) Date of Patent: Oct. 3, 2006

(54) MULTI-STAGE ADJUSTABLE SPRING RESISTANT BELLY MASSAGER

(75) Inventor: Hui-Nan Yu, Taoyuan (TW)

(73) Assignee: Tri-Handling Ltd., Taipei (TW)

( * ) Notice: Subject to any disclaimer, the term of this patent is extended or adjusted under 35 U.S.C. 154(b) by 149 days.

(21) Appl. No.: 10/973,407

(22) Filed: Oct. 27, 2004

(65) Prior Publication Data

US 2006/0089240 A1 Apr. 27, 2006

(51) Int. Cl.
*A63B 21/02* (2006.01)

(52) U.S. Cl. ..... 482/126; 482/121; 482/122

(58) Field of Classification Search ..... 482/126, 482/62–63, 91, 907, 121–130; D21/665, D21/682

See application file for complete search history.

(56) References Cited

U.S. PATENT DOCUMENTS 5,154,685 A * 10/1992 Chen ..... 482/126
5,230,676 A * 7/1993 Terauds ..... 482/53
5,651,755 A * 7/1997 Chen ..... 482/128
5,665,040 A * 9/1997 Ho ..... 482/126
5,690,597 A * 11/1997 Enfaradi ..... 482/126
5,700,232 A * 12/1997 Clausen et al. ..... 482/125
5,746,686 A * 5/1998 Berman et al. ..... 482/125
5,749,815 A * 5/1998 Lipps ..... 482/122
5,795,275 A * 8/1998 Van Der Hoeven et al. 482/122
5,860,898 A * 1/1999 Ellis ..... 482/130
5,913,756 A * 6/1999 Glaser ..... 482/128
5,954,622 A * 9/1999 Olschansky et al. ..... 482/123
5,964,685 A * 10/1999 Boland ..... 482/122

* cited by examiner

*Primary Examiner*—Lori Amerson
(74) *Attorney, Agent, or Firm*—Troxell Law Office, PLLC

(57) ABSTRACT

A multi-stage adjustable spring resistant belly massager comprises a belly massaging pad, a push-pull rod, a resistance adjusting mechanism and two handle grips. The belly massaging pad rests on the human belly, the push-pull rod is mounted in a barrel to perform the up and down movement, the resistance adjusting mechanism surrounds the push-pull rod and the handle grips are for the player to practice the push-pull exercise on the belly. The resistance adjusting mechanism is composed of a plurality of pulling guides, spring straps, a top decorative cover and a lock ring. The player operates the handle grips to carry out the up and down movement on the belly in one way and rotates the push-pull rod around the belly in other way to accomplish the weight reduction and fat removal in the belly.

4 Claims, 9 Drawing Sheets

MULTI-STAGE ADJUSTABLE SPRING RESISTANT BELLY MASSAGER

BACKGROUND OF THE INVENTION

1. Field of the Invention

This invention relates to a belly massager, in particular the novel multi-stage resistance adjustable belly massager.

2. Description of the Related Art

In most cases, the white-collar workers are doing sedentary jobs, a chair-warmer, deficient of physical exercise; the fat therefore builds up gradually in belly, and lion size become more and more corpulent. Due to the lack of time to take physical exercise and inconvenience to go the gymnastics, the belly massager is the simplest tool to solve the fat building problem on the belly.

FIG. 1 shows a prior art of the belly rubbing exerciser which contains a belly massager 1', a T form handle 2' where the belly massager 1' is a lateral bar 11' and the T form handle 2' provides two grips 21'. Between the belly massager 1' and the T form handle 2', there installs a resistance mechanism 3' which composed a pair of lugs 31' fixed to both side of the upper end of the massager 1' and another pair of lugs 32' fixed to both side of the lower end of the handle 2' with a recoil spring 33' between two pairs of lug 32' and locked in place by two pair of lock bolts 331'. When the handle is pressed, the lug 32' will slide down along the slide groove 12' on the massager 1' so as to compress the recoil spring 33' between lug 32' and lug 31'. After the pressing is released, the spring will recoil the handle 2' upward. This downward movement of the handle 2' will attain the fat partial reduction. However, this single downward pressing movement is very dull, not challengeable and the effect of fat reduction is limited requiring much improvement.

SUMMARY OF THE INVENTION

Viewing from the weak points as mentioned above, the inventor has dedicated for years great efforts to improving the belly massager and finally come up with the multi stage spring assistance adjustable belly massager.

The important object of this invention is to provide a multi-stage spring resistance adjustable belly massager mainly comprising a belly massaging pad, a push-pull rod and a multi-stage spring resistance adjusting mechanism. The belly massaging pad rest on the human belly and the push-pull rod is mounted on the belly massaging pad for carrying out the up and down movement. The resistance adjusting mechanism is housed in the barrel of the push-pull rod to rotating movement. The handle grip is mounted on the top end of the push-pull rod for the player to hold and operate the belly massager. The resistance adjusting mechanism consists of a barrel, a plurality of slide guide, spring straps, a top cover and a lock ring. The combination of symmetrical slide guides with a variety of spring straps offers a variety of resistances to meet the individual choice of each player. The compressing movement of the belly massaging pad attains the fat reduction in the belly.

BRIEF DESCRIPTIONS OF THE DRAWINGS

DETAILED DESCRIPTION OF THE PREFERRED EMBODIMENT

Figure 1:
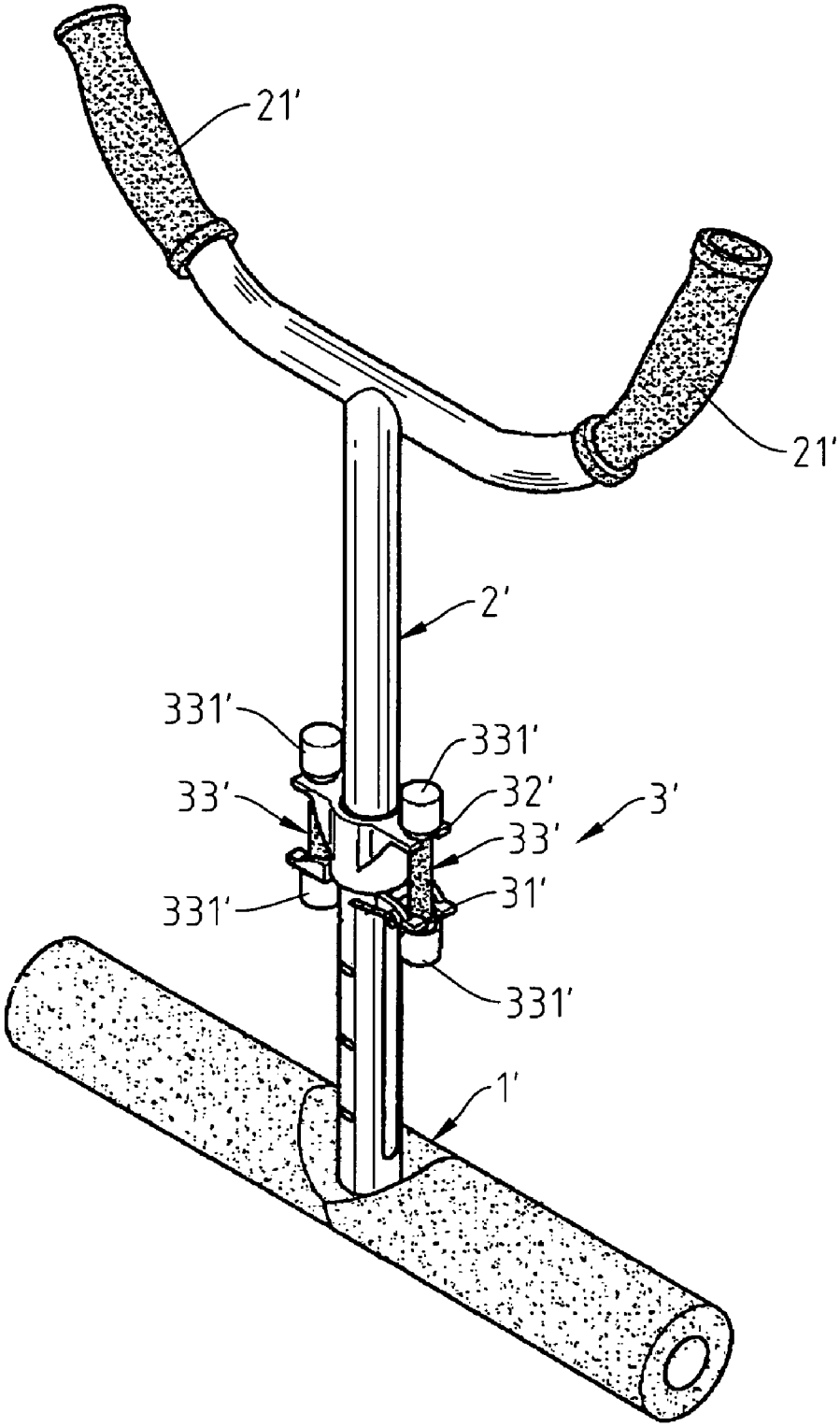
Fig. 1 Prior Art
FIG. 1 shows the schematic diagram of prior art of the belly massager.
Figure 2:
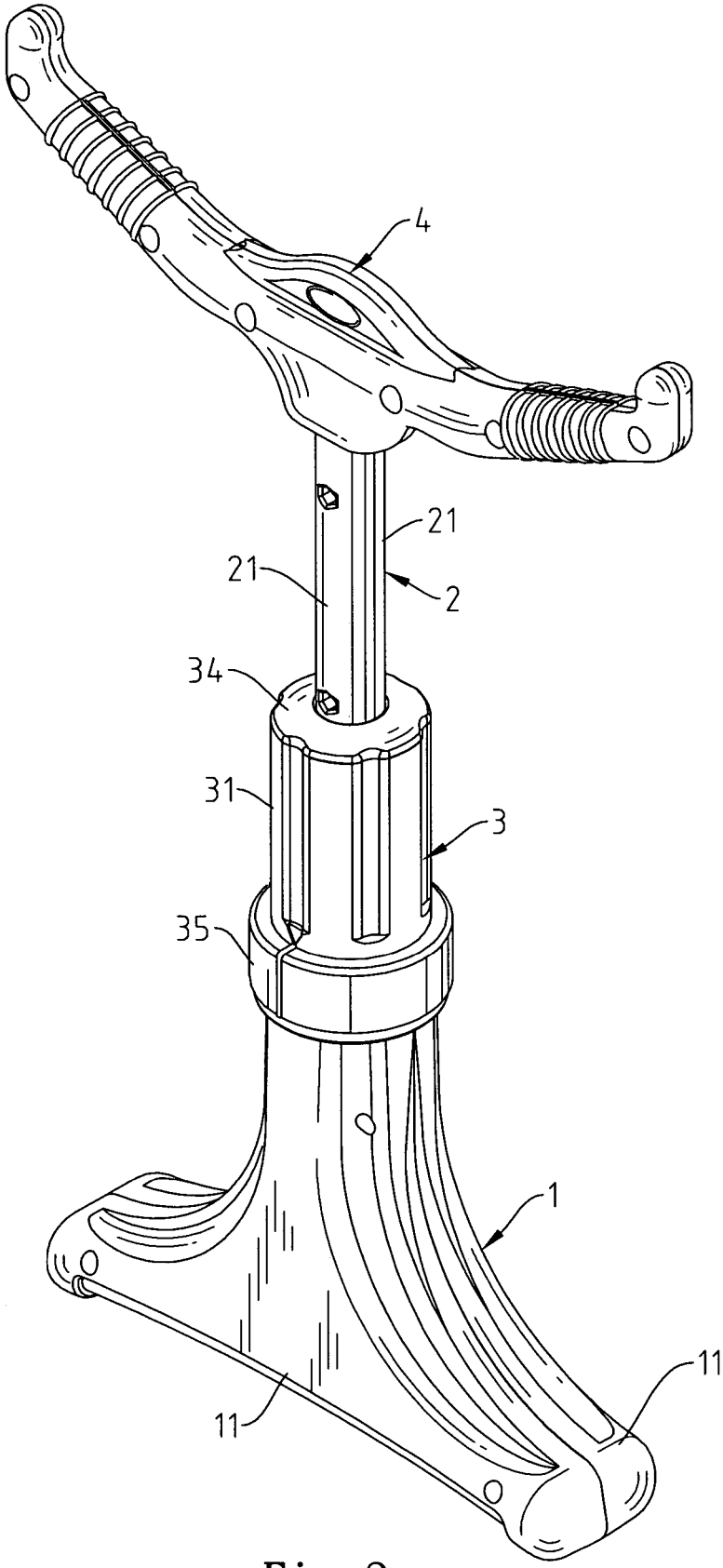
FIG. 2 shows the schematic diagram of the belly massager of this invention
Figure 3:
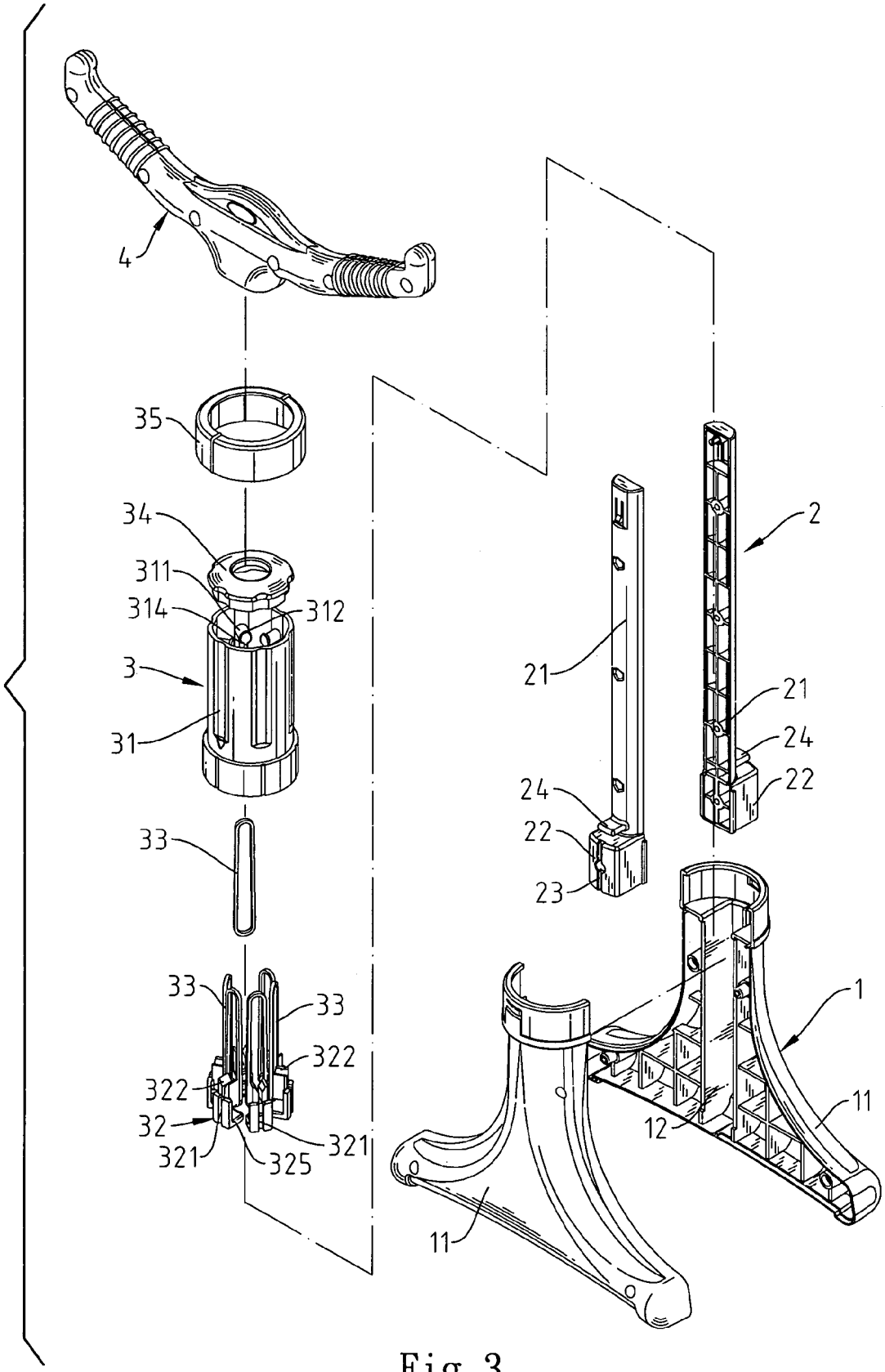
FIG. 3 shows the disassembly of the belly massager of this invention
Figure 4:
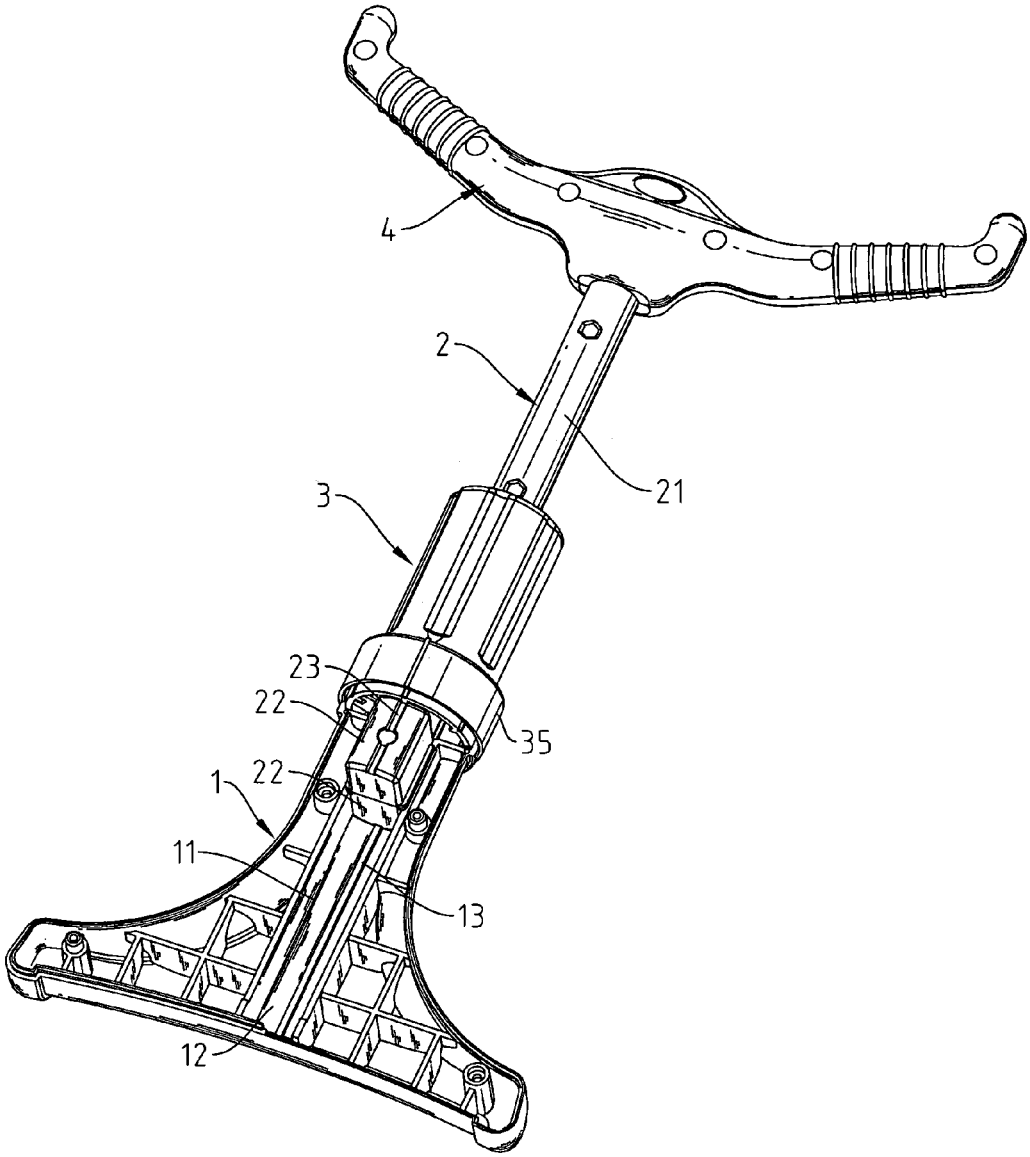
FIG. 4 shows the assembly of the push-pull rod of the belly massager of this invention

As shown in FIGS. 2 through 4, the multi-stage spring resistance adjustable belly massager provided in this invention comprises a belly massaging pad 1, a push-pull rod 2, a resistance adjusting mechanism 3 and two handle grips 4, in which the bottom of the belly massaging pad 1 rest closed on the belly. The push-pull rod 2 is sleeved in the belly massaging pad 1 permitting an up and down movement. The resistance adjusting mechanism 3 is housed in the barrel of the push-pull rod 2 for rotation. The handle grips 4 connected to the upper end of the push-pull rod 2 are for the player to hold and operate the belly massager.

As shown in FIG. 3, the belly massaging pad 1 contains two piece of similar half casing 11 locked together with a slide flute 12, the center of the slide flute 12 protruded a rib 13. The push-pull rod 2 contains also two pieces of symmetrical axle 21. At the lower end of the symmetrical axle 21, there is a slide square 22 with a central concave groove 23, permitting the rib 13 of the slide flute 12 to slide along the concave groove 23 in a straight line movement. The slide square 22 has a stop 24 on the top side.

The resistance adjusting mechanism 3 contains a barrel 31, a plurality of slide guides 32, and a plurality of spring straps 33, a top decorative cover 34 and a lock ring 35. The slide guides 32 and the spring straps 33 are housed in the barrel 31 which is sealed by the top decorative cover 34. The lock ring 35 is mounted on the outer edge of the bottom of the barrel 31; the massaging pad 1 and push-pull rod 2 intergraded allowing the push-pull rod 2 rotates inside of the barrel 31. Inside the barrel 31, there is an integral formed of plurality of retaining pillars 311 in equally spaced and diagonally disposed (in reality, there are six pieces of corresponding retaining pillar 311.) The retaining pillar 311 has a flange 312 on the outer edge, the bottom of the retaining pillar 311 also extended to the protruded rib 314 of top of the concave ring differential part 313 of bottom of the barrel 31. The inner wall of concave ring differential part 313 has a protruded rib 315 corresponding to the protruded rib 314.

Figure 5:
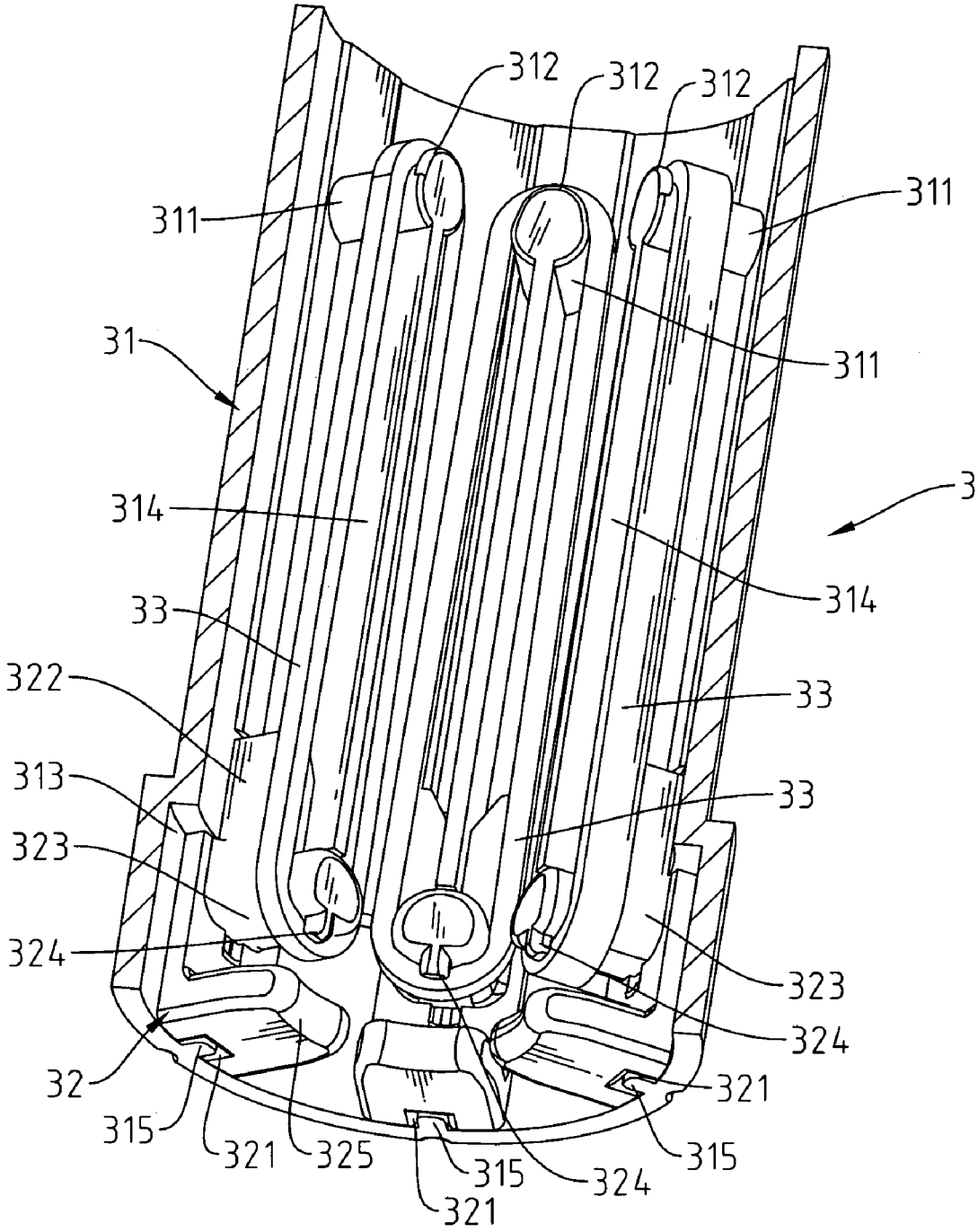
FIG. 5 shows the assembly of the resistance adjusting mechanism and the slide guide of the belly massager of this invention

The number of the slide guides 32 and the spring straps 3 exactly synchronizes to the number of the retaining pillar 311. Each slide guide 32 opens a slide groove 321 on outside of the surface of edge. As shown in the FIG. 5, the slide groove 321 of the slide guide 32 can be corresponding and mounted on the protruded rib 315, so concave ring differential part 313 stop the top of slide guide 32, and the inner wall of the slide guide 32 has a "V" turn clamp 322 to receive the protruded rib 314 of the barrel 31. The bottom of the "V" turn clamp 322 has a retaining pillar 323, and outside of the retaining pillar 323 mounted a protruded stop 324.

So the spring strap 33 hanging firmly on the barrel 31 and between the retaining pillars of 311 and 323 of the slide guide 32, and without slipping off by the stop of flange 312 and protruded stop 324, and permitting the slide guide 32 rotating above the concave ring differential part 313. The concave ring differential part 313 has a flange 325 which maintains a fixed clearance with the retaining pillar 323 on the upper side, this is the clearance allows the stop board 24 of the push-pull rod 2 moves in.

Figure 6:
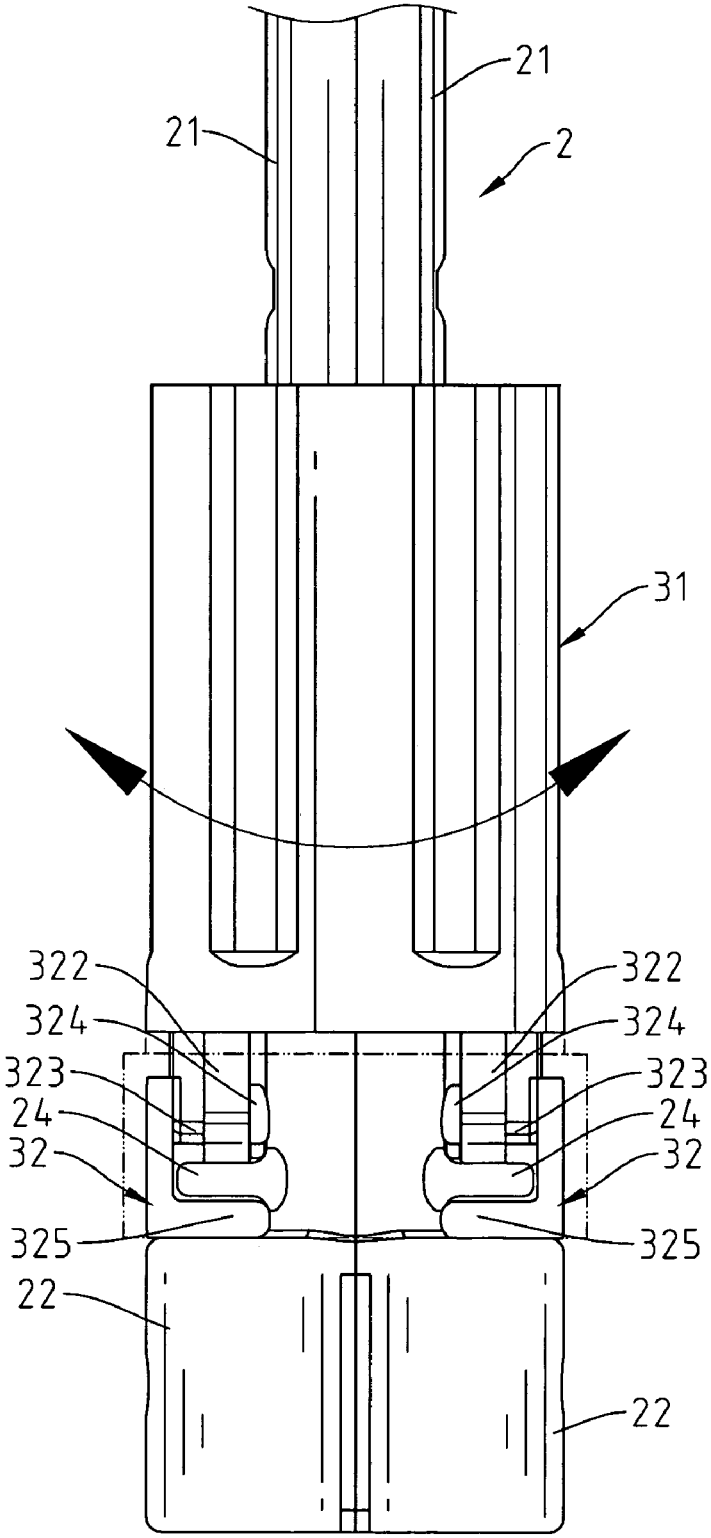
FIG. 6 shows the disposition of the resistance adjusting mechanism when the barrel is rotated.
Figure 7:
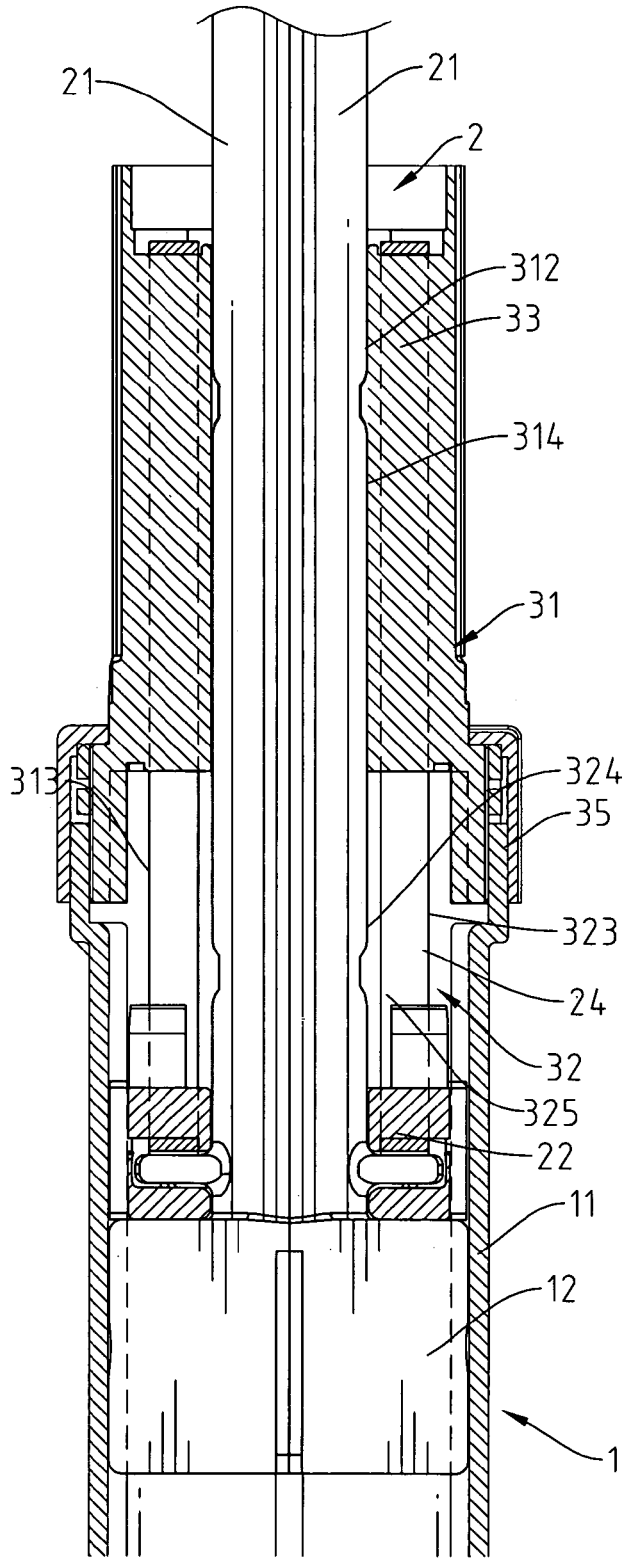
FIG. 7 shows the cross section of belly massaging pad, the push-pull rod and the resistance adjusting mechanism.
Figure 8:
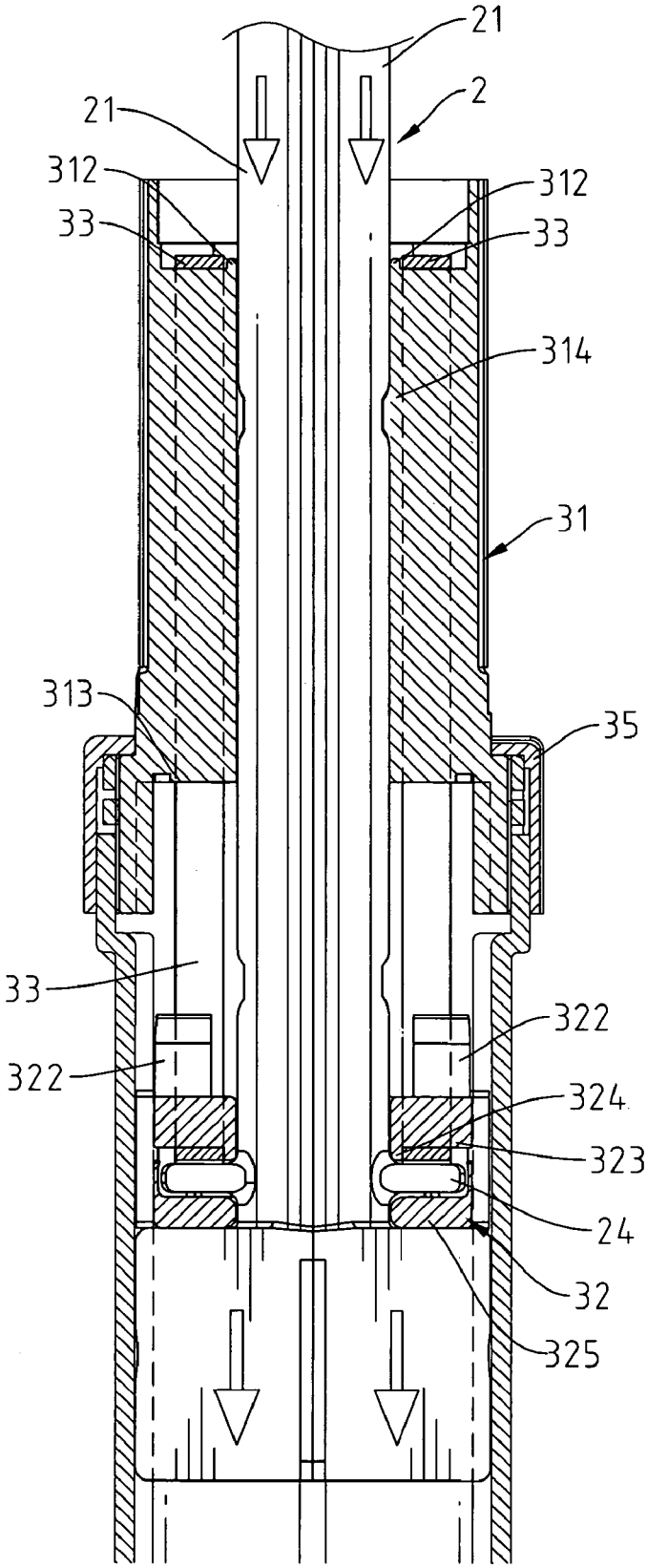
FIG. 8 shows the disposition of the resistance adjusting mechanism when the push-pull rod is pressed downward.
Figure 9:
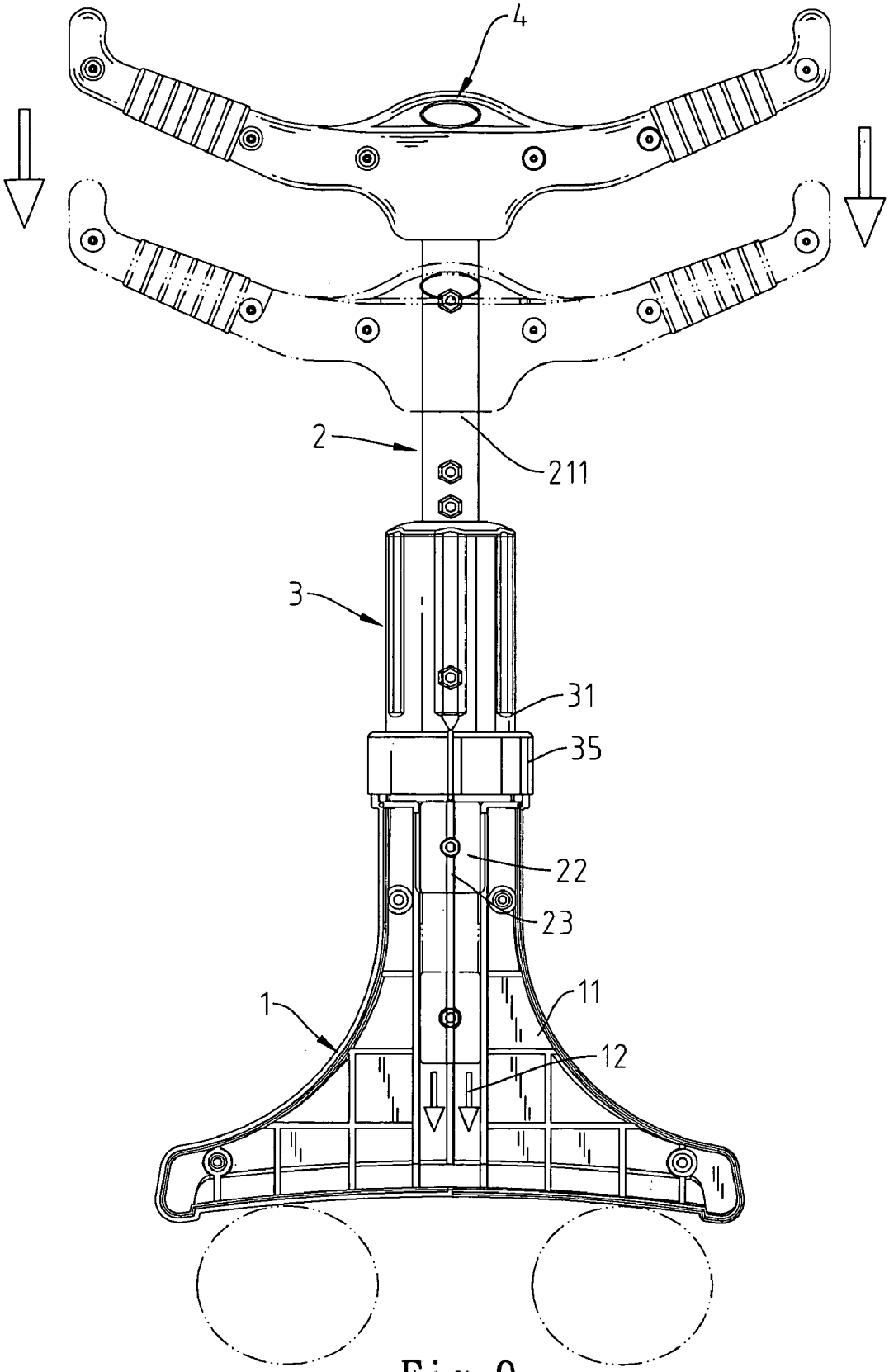
FIG. 9 shows another embodiment of the belly massager of this invention.

As shown in FIG. 6, the push-pull rod 2 will house in the barrel 31 of the resistance adjusting mechanism 3, allowing the stop board 24 of the push-pull rod 2 to sit in the clearance formed by the flange 325 and the retaining pillar 323 (see FIG. 7) and the slide groove 321 of the slide guide 32 will accept the center rib 13 on the slide flute 12 of the belly massaging pad 1. As shown in FIGS. 8 and 9, while the player push the handle grip 4 and the push-pull rod 2 downward, the center groove of the slide square 22 and the stop board 24 of push-pull rod 2 will fit to receive the center rib 13 of the slide flute 12 in a straight line movement, and the slide guide 32 and spring strap 33 will apply a compressive force on the belly so as to form a partial exercise on the belly to effect the fat reduction.

It is clearly learned that the spring straps 33 of the resistance adjusting mechanism 3 are held between the retaining pillars 311 and 323 of the barrel 31. The resistance adjusting mechanism 3 is designed with at least two pairs of spring straps 33 (Figures show the mechanism of three pairs of spring straps) and each pair of spring strap 33 has different strength, that means each pair of the spring strap 33 produces varying compressive force applied to the belly when the slide guide 32 is in operation. When the resistance adjusting mechanism 3 is turned into the barrel 31, the clearance formed between the flange 325 and the retaining pillar 323 will allow the stop board 24 of the push-pull rod 2 to pass, (see FIG. 6) and the spring strap 33 will recoil back and released. This rotary resistance adjusting mechanism 3 and barrel 31 system attains the multi-stage spring resistance adjustment is a progressive improvement, benefiting both for the industry and the players.

What the invention claimed is:

1. A multi-stage spring resistance adjustable belly massager comprising:

a belly massaging pad including two half casing pieces locked together with a slide flute, the center of said slide flute protrudes with a rib, said rib rests on the belly of a user, a push-pull rod including two symmetrical axles and having a slide square at a lower end of said axle with a central concave groove, said rib of said slide flute slides along said concave groove in a straight line movement, a center slide groove corresponding to said center rib of said center flute of said belly massaging pad for maintaining a straight line movement where said slide square has a stop board on a top side, a spring resistance adjusting mechanism for permitting said push-pull rod to rotate within said adjusting mechanism, said resistance adjusting mechanism comprising:

a barrel, a plurality of slide guides, a plurality of spring straps, a top cover, and a lock ring mounted on an outer edge of the bottom of said barrel, wherein said plurality of slide guides and said spring straps are aligned in pairs and disposed face to face to one another within said barrel, and said top cover seals said barrel at an upper end and said lock ring connects said barrel to said belly massaging pad, said plurality of spring straps are affixed between said barrel and said plurality of slide guides to prevent said straps from slippages, said plurality of spring straps further being interchangeable for different elastic strengths thereby producing a different spring resistance for permitting the push-pull rod to rotate at a lower end of said barrel where said push-pull rod is guided by said slide groove along said center rib to keep a downward straight line movement, two handle grips for a user to hold and operate, whereby a user is positioned to select a different elastic resistance by rotating said spring resistance mechanism and with the combination of symmetrical slide guides and a variety of spring straps, the compressing movement of the massaging pad of the multi-stage resistance adjustment mechanism and recoil effect attains the reduction in fat of the belly of the user, each of said plurality of slide guides open a slide groove on the outside surface edge of said barrel, said slide groove is mounted on a protruded rib of an inner wall of a concave ring differential part so that the concave ring differential part stops the top of said slide guides, and an inner wall of the slide guide has a "V" turn clamp for receiving a protruded rib of said barrel, where the bottom of said clamp has a retaining pillar and a protruded stop causing said spring straps to hang firmly on said barrel and between said pillars of said slide guide without slipping off and permitting said slide guide to rotate above said concave ring differential part, said resistance adjusting mechanism is further contained within an integral; said integral includes a plurality of equally spaced and diagonally disposed retaining pillars; said retaining pillars having a flange on a outer edge and a bottom of said pillars also extends into a protruded rib on top of a concave ring differential part on the bottom of said barrel, an inner wall of said concave ring differential part also having a protruded rib corresponding to said protruded rib on a top part of said concave ring differential part.

2. The multi-stage spring resistance adjustable belly massager according to claim 1 wherein said plurality of slide guides and said plurality of spring straps synchronize to said plurality of retaining pillars, each of said plurality of slide guides open a slide groove on the outside surface edge of said barrel, said slide groove is mounted on a protruded rib of an inner wall of a concave ring differential part so that the concave ring differential part stops the top of said slide guides, and an inner wall of the slide guide has a "V" turn clamp for receiving a protruded rib of said barrel, where the bottom of said clamp has a retaining pillar and a protruded stop causing said spring straps to hang firmly on said barrel and between said pillars of said slide guide without slipping off and permitting said slide guide to rotate above said concave ring differential part.

3. The multi-stage spring resistance adjustable belly massager according to claim 2 further including an inner wall of said plurality of slide guides having a protruding flange which maintains a fixed clearance with said plurality of retaining pillars on an upper side, said clearance allows a stop board of said push-pull rod to move.

4. The multi-stage spring resistance adjustable belly massager according to claim 3 wherein said push-pull rod is within said barrel of said resistance adjusting mechanism for allowing said stop board of said rod to reside in said clearance formed by said flange and said plurality of retaining pillars, said center slide groove of said plurality of said slide guides receives said center rib on said slide flute of said belly massaging pad so that when the handle grip is pushed and the push-pull rod moves downward, said central concave groove of said slide square and said stop board of said push-pull rod receives said center rib of said slide flute in a straight line movement where said plurality of slide guides and said plurality of spring straps apply a compressive force on the belly of a user.

* * * * *